United States Patent [19]

Brassfield

[11] Patent Number: 4,639,233

[45] Date of Patent: Jan. 27, 1987

[54] DOLL HAVING MEANS TO CONVERT FROM ONE CHARACTER TO ANOTHER

[76] Inventor: Brian Brassfield, 2024 A. N. E., Miami, Okla. 74354

[21] Appl. No.: 761,546

[22] Filed: Aug. 5, 1985

[51] Int. Cl.[4] ..... A63H 3/16; A63H 3/12; A63H 3/20

[52] U.S. Cl. ..... 446/321; 446/340; 446/99

[58] Field of Search ..... 446/97, 98, 99, 100, 446/321, 337, 339, 340, 71, 72, 73, 372

[56] References Cited

U.S. PATENT DOCUMENTS

| | | | |
|---|---|---|---|
| 1,059,178 | 4/1913 | Lombra | 446/321 |
| 2,274,303 | 2/1942 | Ornstein | 446/99 |
| 3,737,196 | 6/1973 | Bodor | 446/73 X |
| 3,811,220 | 5/1974 | Glass et al. | 446/321 |
| 3,851,419 | 12/1974 | Kaelin | 446/321 |
| 4,413,442 | 11/1983 | McSweeney | 446/73 |
| 4,580,992 | 4/1986 | McKay | 446/99 X |

FOREIGN PATENT DOCUMENTS

| | | | |
|---|---|---|---|
| 2013508 | 8/1979 | United Kingdom | 446/99 |

*Primary Examiner*—Robert A. Hafer
*Assistant Examiner*—D. N. Muir
*Attorney, Agent, or Firm*—Head, Johnson & Stevenson

[57] ABSTRACT

A convertable doll having means to change from one character to another without adding to or removing any object. The doll is formed of a body having a face thereon providing one character. A loose fitting outer garment is received on the body, the garment having an open type lower portion such as a robe, skirt, dress or the like. An inverted skirt-type flexible member is received on the doll lower portion under the outer garment and has on the underneath side thereof elements forming an upper body, face and outer head features and having a second pair of arms, the flexible members being invertable over the doll body head portion to encompass the head portion and the doll body arms, the lower portion of the outer garment being receivable in the inverted flexible member, the inverted flexible member thereby forming a second head and face forming a second character.

3 Claims, 7 Drawing Figures

26
30B
24
18B
22B
18A
22A
30A
34
14
20B
20A

DOLL HAVING MEANS TO CONVERT FROM ONE CHARACTER TO ANOTHER

SUMMARY OF THE INVENTION

The invention relates to a unique type of doll which is convertable from one character to another without adding anything to the doll or taking anything from it. Others have provided convertable dolls such as revealed in U.S. Pat. Nos. 1,396,766; 1,966,986; 2,195,127; 2,325,750; and Austrian Pat. No. 163,916. These prior art devices are convertable dolls having two separate head portions with garments arranged to reveal either one head or the other. The doll of the present invention does not have two separate head portions.

The present doll is formed of a body having a torso, legs, feet, a flexible pair of arms and a head portion, the head portion having a face which provides one character. A loose fitting outer garment is positioned on the body, the garment having an open type lower portion such as a robe, skirt, dress, kilts or the like which does not receive the doll legs separately. A first under garment lower portion is received on the doll body which receives both legs thereof.

Positioned under the outer garment and over the first under garment is an inverted skirt type flexible member which is received on the doll body lower portion. The flexible member has, on the underneath side thereof, elements forming upper body, face and outer head features. In addition, the flexible member has, as a part thereof, a second pair of arms.

In the doll first character attitude the head and outer garment with the hands from the arms extending past the outer garment and the feet of the doll are exposed producing, in combination, a doll having one distinct character. When the flexible member is inverted up over the doll's head and the lower portion of the outer garment is stuffed into the inverted flexible member and the flexible pair of arms forming a part of the body torso are stuffed also into the inverted flexible member, the doll changes character completely.

A preferred arrangement also includes a drawstring received in the lower portion of the flexible member so that when it is inverted and the outer garment and arms of the torso are stuffed in the inverted flexible member the drawstring can be used to draw the flexible member closed forming a more rounded head configuration of the doll when presenting the second character.

The invention will be better understood in reference to the following description and claims taken in conjunction with the attached drawings.

DESCRIPTION OF THE DRAWINGS

FIG. 1 shows one character of the convertable doll.

DESCRIPTION OF A PREFERRED EMBODIMENT

Figures 1, 2, 3, 4:
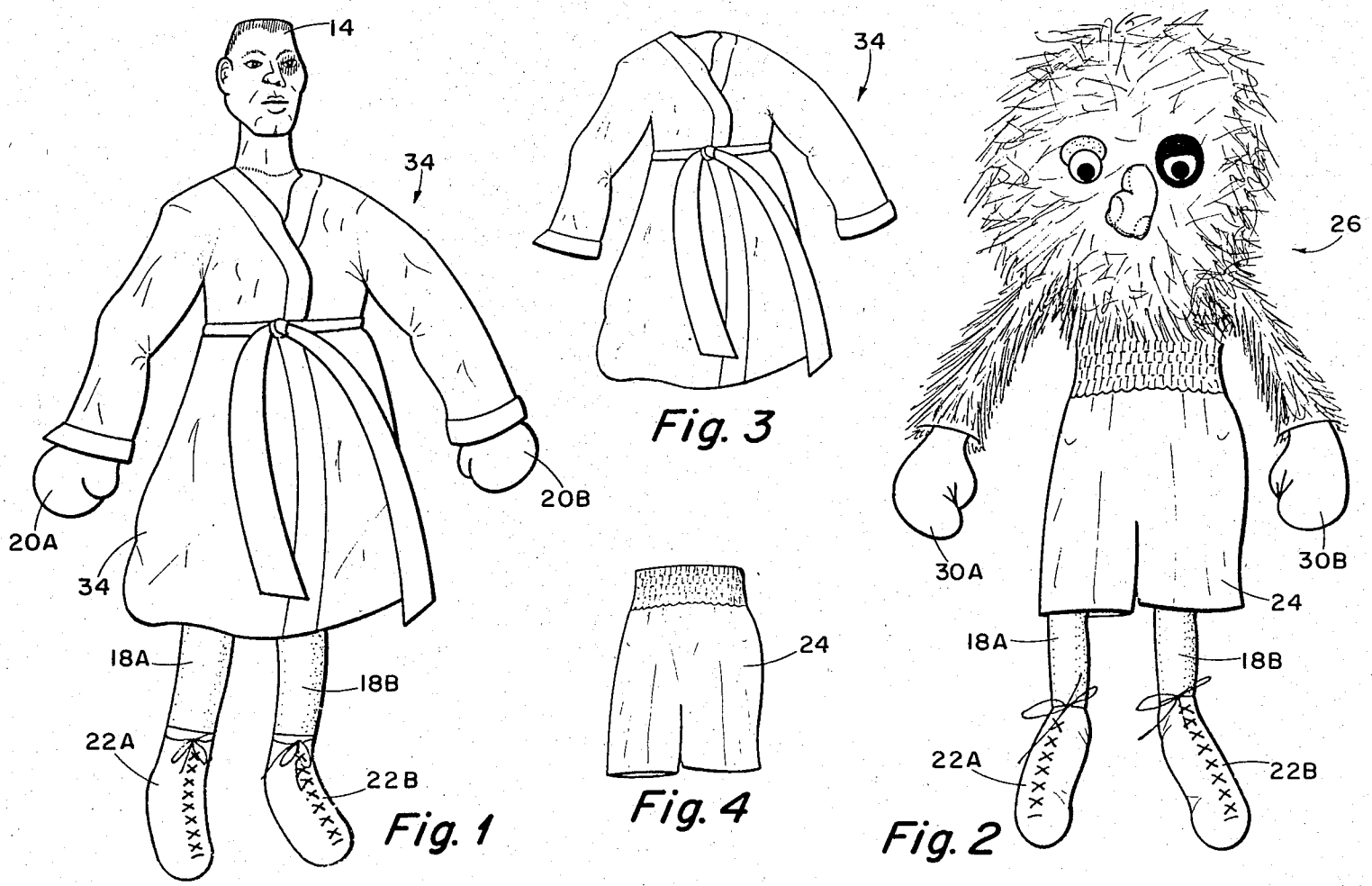
FIG. 1 is one embodiment of a doll employing the principles of this invention, it being understood that the doll illustrated is by way of example only.
FIG. 2 is an example of the same doll structure as in FIG. 1 changed to a different character without adding to or taking anything away from the doll of FIG. 1.
FIG. 3 is an outer garment, shown in reduced size, as employed on the doll of FIG. 1.
FIG. 4 is a first under garment, shown in reduced size, as employed on the doll of FIG. 1 and which is exposed in the character of the doll of FIG. 2.
Figure 6:
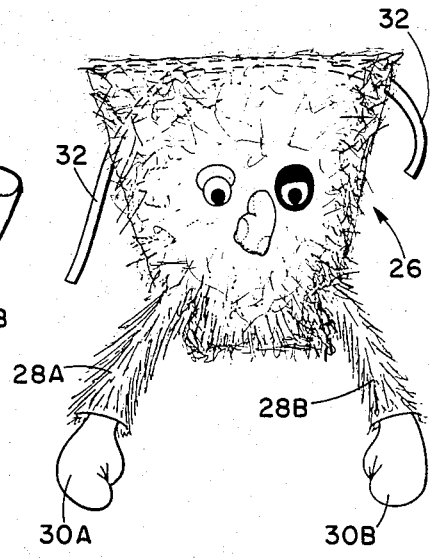
FIG. 6 is the depiction of the invertable skirt type flexible member showing it inverted in the position taken during the transformation of the doll from the character of FIG. 1 to the character of FIG. 2.
Figure 5:
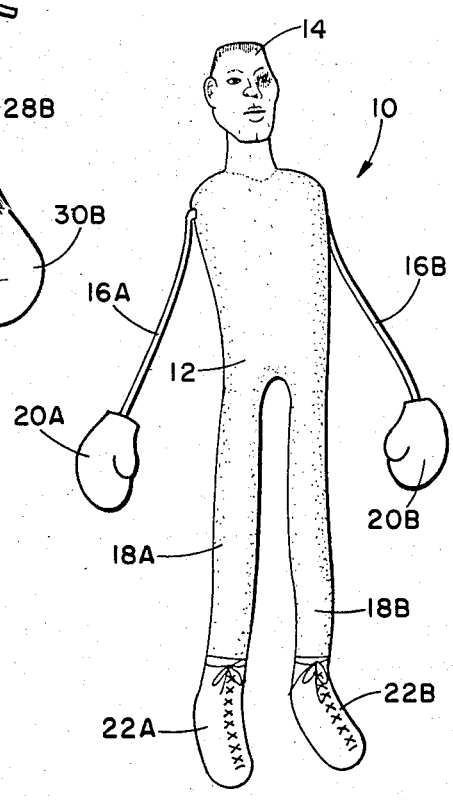
FIG. 5 is the torso of the doll of both FIGS. 1 and 2 showing shoes and boxing gloves but without other garments.

Referring to the drawings and first to FIG. 1 a typical doll employing the principles of this invention as illustrated. The doll of FIG. 1 is formed of a doll body generally indicated by the number 10 in FIG. 5, including a torso 12, head 14, a pair of arms 16A and 16B and legs 18A and 18B. The arms 16A and 16B are highly flexible and may have hands on the lower end or other elements such as the boxing gloves 20A and 20B shown. The legs have shoes 22A and 22B. Positioned on the body 10 is a first under garment 24, shown in FIG. 4, which is of the type to receive both legs 18A and 18B. Also received on the doll of FIG. 1 but not seen in FIG. 1, is an invertable skirt-type, flexible member 26 shown in the inverted position in FIG. 6. The flexible member 26 has an inner and outer surface, the inner surface being exposed in the inverted position as shown in FIG. 6 to show elements thereon to form facial characters such as a nose and eyes. Although not shown, any other facial feature may be also affixed to the under surface of the flexible member 26.

Formed as a part of the flexible member 26 are flexible arms 28A and 28B which have, at the lower ends thereof, hands or coverings for the hands, such as boxing gloves 30A and 30B.

The flexible member 26 preferably has, in the lower end thereof (which is in the upper end as shown in the inverted position of FIG. 6) a drawstring 32, the purposes of which will be described subsequently.

In the doll of FIG. 1 the under garment 26 is folded downwardly, encompassing the arms 28A and 28B which are not seen in FIG. 1.

Received on the doll is an outer garment 34 as shown in FIG. 3. The outer garment is loose fitting and the bottom portion is open such as a robe as shown, or such as a skirt, dress, kilts or the like.

Figure 7:
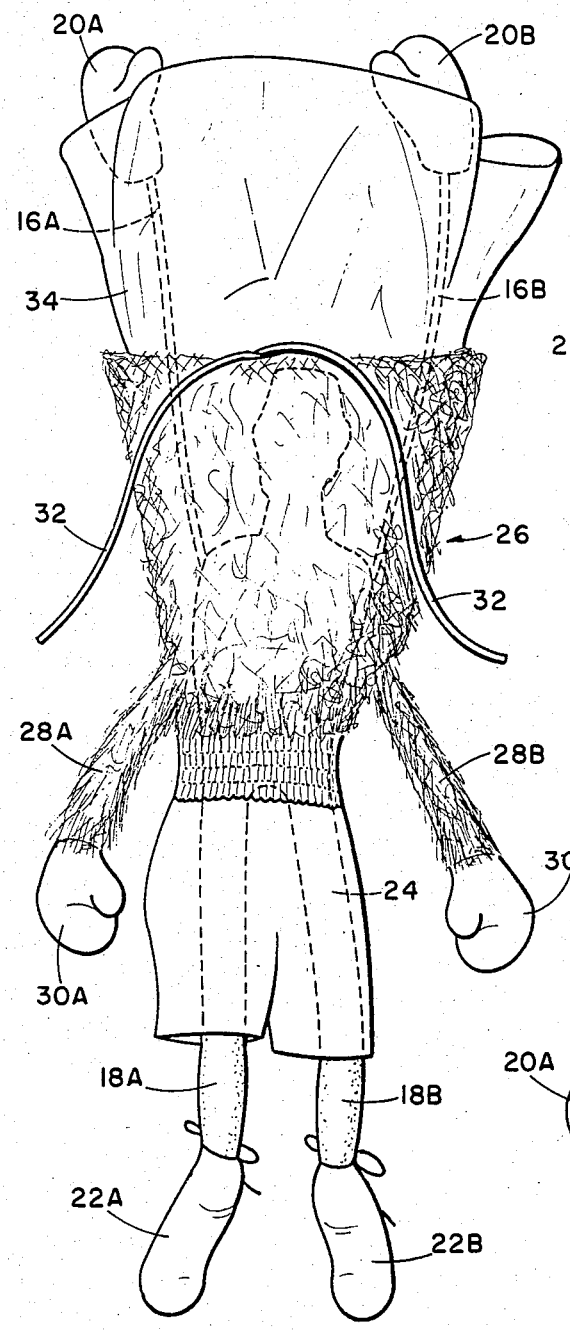
FIG. 7 is the doll of FIGS. 1 and 2 in the process of being converted from one character to the other in which the flexible member is inverted. The facial characters affixed to the underneath surface of the flexible member are not shown in FIG. 7 so as to reveal, in dotted outline, the upper torso and head portion of the doll.

To convert the doll from the character of FIG. 1 to the character of FIG. 2, the user merely inverts the outer garment 34 and inverts the flexible member 26 into the position as shown in FIG. 7. The lower portion of the outer garment 34 and the flexible arms 16A and 16B, including members attached thereto such as the boxing gloves 20A and 20B, are stuffed downwardly into the upper inverted flexible member 26. After these have been stuffed into the inverted flexible member, the drawstring 32 may be drawn and tied. The ends of the drawstring can be inserted back into the interior of the drawn together edge of the flexible member it being understood that when drawing the member together a small opening of sufficient size would be left before the drawstring is tied so as to enable the excess portions of the drawstring to be stuffed through the opening to be thereby encompassed by the flexible member.

The conversion is accomplished expeditiously, usually requiring less than a minute to transform the doll having the character of FIG. 1 to the doll having the character of FIG. 2 and without adding anything or taking anything away from the doll.

To transform the doll back to the character of FIG. 1 all that is required is that the drawstring be released and the flexible member and outer garment be reinverted back to their original positions as in FIG. 1.

The dolls illustrated herein is exemplary of the principles of the invention in which an invertable skirt type flexible member is in one character, received under an outer garment, and in another character, forms the upper and body, head and face.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A doll having means to convert from one character to another, comprising:

a doll body including a torso, legs, feet, a flexible pair of arms and a head portion, the head portion having a face thereon providing a first character;

a loose fitting outer garment received on said body, the garment having an open type lower portion such as a robe, skirt, dress, kilts or the like which does not receive said legs separately;

a first under garment lower portion received on said doll body and receiving both legs thereof;

an invertable skirt-type, flexible member received on said doll lower portion over said first under garment and under said outer garment and having, on the underneath side thereof, elements forming upper body, face, and outer head features, the flexible member being invertable and maintained over said doll body head portion to encompass said head portion, the lower portion of said outer garment being receivable inside the inverted flexible member, the inverted flexible member thereby forming a second head and face of said doll body providing a second character.

2. A doll according to claim 1 including a drawstring received by the lower portion of said flexible member which can be drawn when said flexible member is inverted over said doll head.

3. A doll according to claim 1 including a second pair of arms affixed to said flexible member inner surface, said first body flexible arms being encompassed within the inverted flexible member when it is inverted over said head portion, said second pair of arms extending at the sides of said body torso when said flexible member is in the inverted position.

* * * * *